US005612769A

United States Patent [19]

Sugihara et al.

[11] Patent Number: 5,612,769

[45] Date of Patent: Mar. 18, 1997

[54] SUBMODULAR UNIT FOR USE IN A MODULAR ROTARY DEVELOPING APPARATUS

[75] Inventors: Kazuyuki Sugihara, Yokohama; Katsuhiro Kosuge, Tokyo, both of Japan

[73] Assignee: Ricoh Company, Ltd., Tokyo, Japan

[21] Appl. No.: 328,478

[22] Filed: Oct. 25, 1994

[30] Foreign Application Priority Data

Oct. 25, 1993 [JP] Japan ..... 5-266660
Nov. 26, 1993 [JP] Japan ..... 5-296658

[51] Int. Cl.[6] ..... G03G 15/01

[52] U.S. Cl. ..... 399/119; 399/228; 399/284

[58] Field of Search ..... 355/326 R, 327, 355/328, 245, 260, 200; 118/645, 653, 657–658; 222/DIG. 1

[56] References Cited

U.S. PATENT DOCUMENTS

| | | | |
|---|---|---|---|
| 4,772,913 | 9/1988 | Watanabe | 355/326 R |
| 4,772,916 | 9/1988 | Mochida | 355/327 |
| 4,782,360 | 11/1988 | Iwamoto et al. . | |
| 4,792,825 | 12/1988 | Saito et al. . | |
| 4,894,684 | 1/1990 | Nakajima et al. | 355/207 |
| 4,970,561 | 11/1990 | Mizuno | 355/326 R |
| 5,103,764 | 4/1992 | Fujiwara et al. | 118/645 |
| 5,198,866 | 3/1993 | Kimura et al. | 355/326 R |
| 5,258,819 | 11/1993 | Kimura et al. | 355/326 R |

FOREIGN PATENT DOCUMENTS

| | | |
|---|---|---|
| 62-109074 | 5/1987 | Japan . |
| 62-163072 | 7/1987 | Japan . |
| 62-163071 | 7/1987 | Japan . |
| 62-163073 | 7/1987 | Japan . |
| 63-78170 | 4/1988 | Japan . |
| 63-78171 | 4/1988 | Japan . |
| 63-78173 | 4/1988 | Japan . |
| 63-78172 | 4/1988 | Japan . |
| 63-78169 | 4/1988 | Japan . |
| 5-241417 | 9/1993 | Japan . |

*Primary Examiner*—Thu A. Dang
*Attorney, Agent, or Firm*—Woodcock Washburn Kurtz Mackiewicz & Norris

[57] ABSTRACT

For image reproduction, a submodular unit including a developing roller and a doctor blade is adjustably mounted on a modular developing unit of a rotary developing apparatus. In general, the modular developing unit is rotatably positioned to juxtapose a photoreceptor drum. This juxtaposed position defines the developing position. The toner loaded on the developing roller in the developing position travels over a spacial gap between the developing roller surface and the photoreceptor drum surface. This crucial gap is necessary for successful image reproduction. However, this gap usually cannot be optimally maintained over extended time. The gap is also changed due vibration caused during shipment. In adjusting the gap, the submodular unit allows an independent and fine adjustment for each modular image developing unit. The submodular unit also allows an efficient assembly of the modular rotary developing unit.

12 Claims, 6 Drawing Sheets

SUBMODULAR UNIT FOR USE IN A MODULAR ROTARY DEVELOPING APPARATUS

FIELD OF THE INVENTION

The present invention relates to a modular unit for use in developing apparatus for image reproduction and, in particular, relates to a submodular unit frame for encasing only a developing roller and a doctor blade adjustably mounted to a main modular unit frame in a rotary developing apparatus for a copier, a facsimile, and the like.

BACKGROUND OF THE INVENTION

In general, an image reproduction apparatus reproduce images on an image-carrying medium by transferring toner or developer to the medium in relation to a given image. Such transfer is typically achieved through the use of a developing unit which places toner or developer on the image-carrying medium via a photoreceptor drum. To accomplish image transfer, the photoreceptor drum surface is first prepared by an electrophotographic image process to selectively accept toner in relation to the image. The developing unit then applies toner onto the photoreceptor drum via a developing roller. Toner representing the desired image on the photoreceptor drum is transferred onto an image-carrying medium such as paper. Further processing of the paper, for example, the application of heat, serves to permanently adhere the toner to the paper.

In recent years, rotary developing apparatus having multiple developing units have been proposed for color copiers, color printers and other image-forming apparatus as disclosed, for example, in U.S. Pat. Nos. 4,782,360, 4,792,825, 5,258,819, and Japanese Laid Open Publication 4-10070. In general, multiple independent developing units are housed in the rotary developing apparatus. Each of the multiple developing units are positioned around a cylindrical housing of the rotary developing apparatus and independently applies toner of a different color to a photoreceptor drum. To apply toner, only one independent developing unit is juxtaposed to the photoreceptor drum at a given time. Thus, for example, if four colors such as yellow, magenta, cyan and black are used, a developing unit containing one of these colors is rotatably positioned to juxtapose the photoreceptor drum to apply toner of the particular color according to a desired image.

Toner is selectively applied onto the photoreceptor drum across a gap between the drum and a developing roller. Toner is uniformly applied to the developing roller in a developing unit. The amount of toner on the developing roller is regulated by a doctor blade. Toner is assisted to apply onto the photoreceptor drum surface by carriers. If the gap is not maintained at a predetermined distance, an optimal amount of toner will not be transferred onto the photoreceptor drum surface. Thus, for accurate image production, a relatively constant gap distance is crucial.

Despite an initial factory adjustment, many conventional image reproducing apparatus did not correctly maintain the gap during shipping or after extended use. To maintain accurate image reproduction, the gap must be periodically adjusted. In the past, the gap was adjusted by moving the developing apparatus with respect to the photoreceptor drum. However, this form of gap adjustment creates particular problems for rotary-type developing apparatus.

As described above, rotary developing apparatus house multiple developing units which rotate about a single axis. Due to this construction, if the position of the rotary apparatus is moved with respect to a photoreceptor drum, the gap distance will change for all developing units. Thus, in the past, this type of gross gap adjustment did not provide fine gap adjustment for each developing unit. In addition, this prior gap adjustment technique did not accommodate various kinds of toner which may require different gap distances for optional transfer.

The current invention is directed to an apparatus and a method for providing an independent gap adjustment for each developing unit in a rotary developing apparatus. In addition, the solution provided by the current invention also improves the assembly process as well as the maintenance process of a rotary developing apparatus.

SUMMARY OF THE INVENTION

To solve the above problems, an apparatus according one preferred embodiment of the current invention discloses a modular developing apparatus for developing an image on an image-carrying medium according to toner selectively applied to a photoreceptor drum, a main modular unit frame juxtaposed to the photoreceptor drum for housing modular developing units, including: a submodular unit frame adjustably mounted on the main modular unit frame; and a developing roller mounted on said submodular unit frame for applying the toner onto the photoreceptor drum.

According to a second aspect of the current invention, a modular developing apparatus for developing an image on an image-carrying medium according to toner selectively applied to a photoreceptor drum, a main modular unit frame juxtaposed to the photoreceptor drum for housing modular developing units, including: a submodular developing unit frame adjustably mounted on the main modular unit frame; a developing roller mounted on the submodular unit frame for applying the toner onto the photoreceptor drum; and a doctor blade mounted on the submodular unit frame to juxtapose the developing roller for controlling an amount of the toner to be applied onto the photoreceptor drum.

According to a third aspect of the current invention, a rotary modular developing apparatus includes a rotary developing device having a plurality of independent developing units placed around an outer surface, each developing unit containing a different color of toner, the rotary developing device juxtaposing the photoreceptor and rotating for selectively applying toner onto the photoreceptor drum; and a plurality of submodular unit frames each adjustably mounted on the independent developing units, each of the submodular unit frames housing a developing roller for temporarily holding toner and a doctor blade for regulating the amount of the toner on the developing roller, each of the submodular unit frames being independently moved so as to adjust a gap between the developing roller and the photoreceptor.

According to a fourth aspect of the current invention, a method of assembling a modular rotary developing apparatus having a main modular unit and a submodular unit, toner being transported to a developing roller via a transportation mechanism, a doctor blade regulating the amount of the toner on the developing roller, the toner being selectively applied to a photoreceptor drum via the developing roller, comprising the steps of: (a) placing the transportation mechanism in the main modular unit; (b) placing the development roller and the doctor blade in the submodular unit;

(c) placing the submodular unit assembled in step (b) into the main modular unit assembled in step (a); and (d) placing the main modular unit assembled in step (c) adjacent to the photoreceptor.

According to a fifth aspect of the current invention, a method of adjusting a modular unit of a rotary developing apparatus, the rotary developing apparatus having a main modular unit and a submodular unit, the main modular unit being juxtaposed to an photoreceptor drum, the submodular unit including an adjustable screw and a developing roller, comprising the steps of: (a) making the main modular unit exposed so as to allow an operator to have access to the submodular unit; (b) loosening the adjustable screw on the submodular unit; (c) adjusting a gap between the developing roller and the photoreceptor drum; and (d) tightening the adjustable screw to stabilize the submodular unit.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
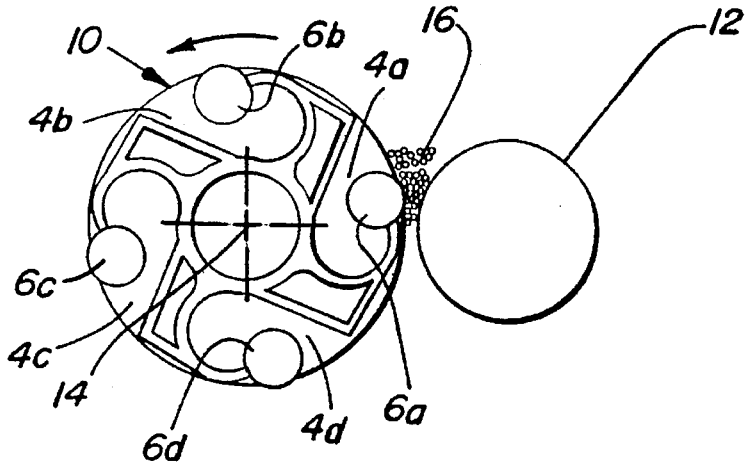
FIG. 1 illustrates positional relations among a rotary developing apparatus, developing rollers and a photoreceptor drum.

Referring now to the drawings, wherein like reference numerals designate corresponding structure throughout the views, and referring in particular to FIG. 1, a general relation between rotary developing apparatus 10 and photoreceptor drum 12 is illustrated. The rotary developing apparatus 10 rotates around axis 14 in a counter-clockwise direction as indicated by an arrow. In this preferred embodiment, rotary developing apparatus 10 houses four independent developing units 4*a*–4*d*, and each developing unit contains a different color toner such as cyan, magenta, yellow and black for color image production.

Developing rollers 6*a*–6*d* are disposed about the circumference of housing 10. As housing 10 rotates, each developing roller is juxtaposed to drum 12. As shown in FIG. 1, developing roller 6*a* is rotatably positioned to juxtapose photoreceptor drum 12. This close position to photoreceptor drum 12 defines a developing position.

In general, to reproduce a color image on paper, the developing roller at the developing position applies toner of a particular color to photoreceptor drum 12 according to a given image. Toner on the photoreceptor drum is thereafter transferred to an image forming medium, such as paper (not shown). In particular, the photoreceptor drum surface is first prepared via an electrophotographic image process to selectively accept toner. Each developing unit loads toner onto an associated developing roller. Toner on the developing roller at the developing position is selectively transferred onto the photoreceptor drum over a spacial gap. A correct distance for this spacial gap is critical for successful toner transfer. Carrier 16 for facilitating this gap transfer is known in the art of electrophotographic image processing. This transfer process repeats for different colors after placing each developing unit at the developing position. Lastly, the transferred toner representing the desired image on the photoreceptor drum is transferred onto the paper.

Figure 2:
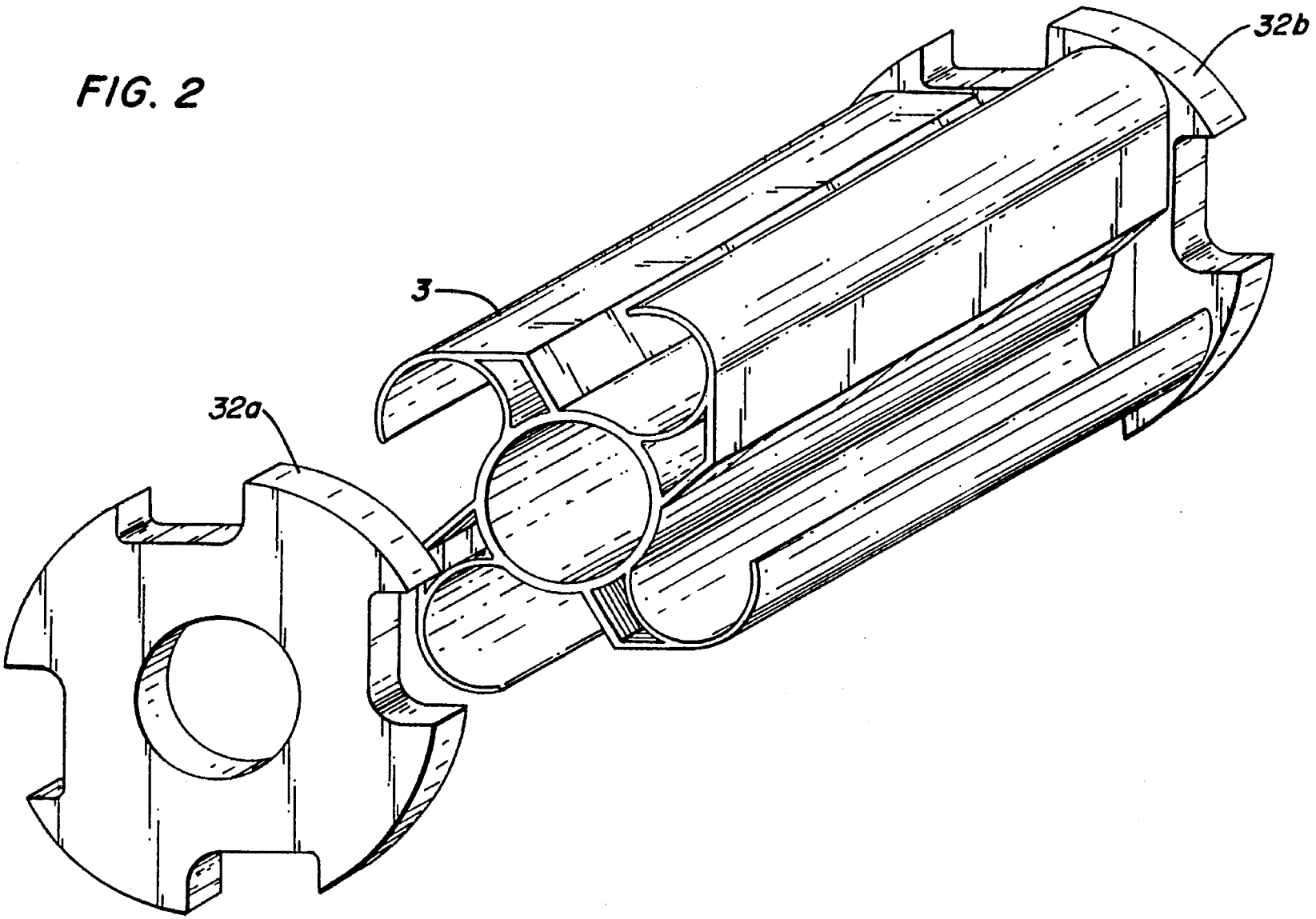
FIG. 2 shows a perspective view of a main modular frame unit providing compartments for each housing a set of modular components.

FIG. 2 shows a perspective view of main modular unit frame 3 with pair of side walls 32*a*, 32*b*. According to one preferred embodiment, main modular unit frame 3 is placed within the rotary developing apparatus housing (not shown) and divides housing 10 into four compartments for independent developing units. Main modular unit frame 3 also provides structural support for housing 10 by connecting each end to side walls 32*a* and 32*b*.

Figure 3:
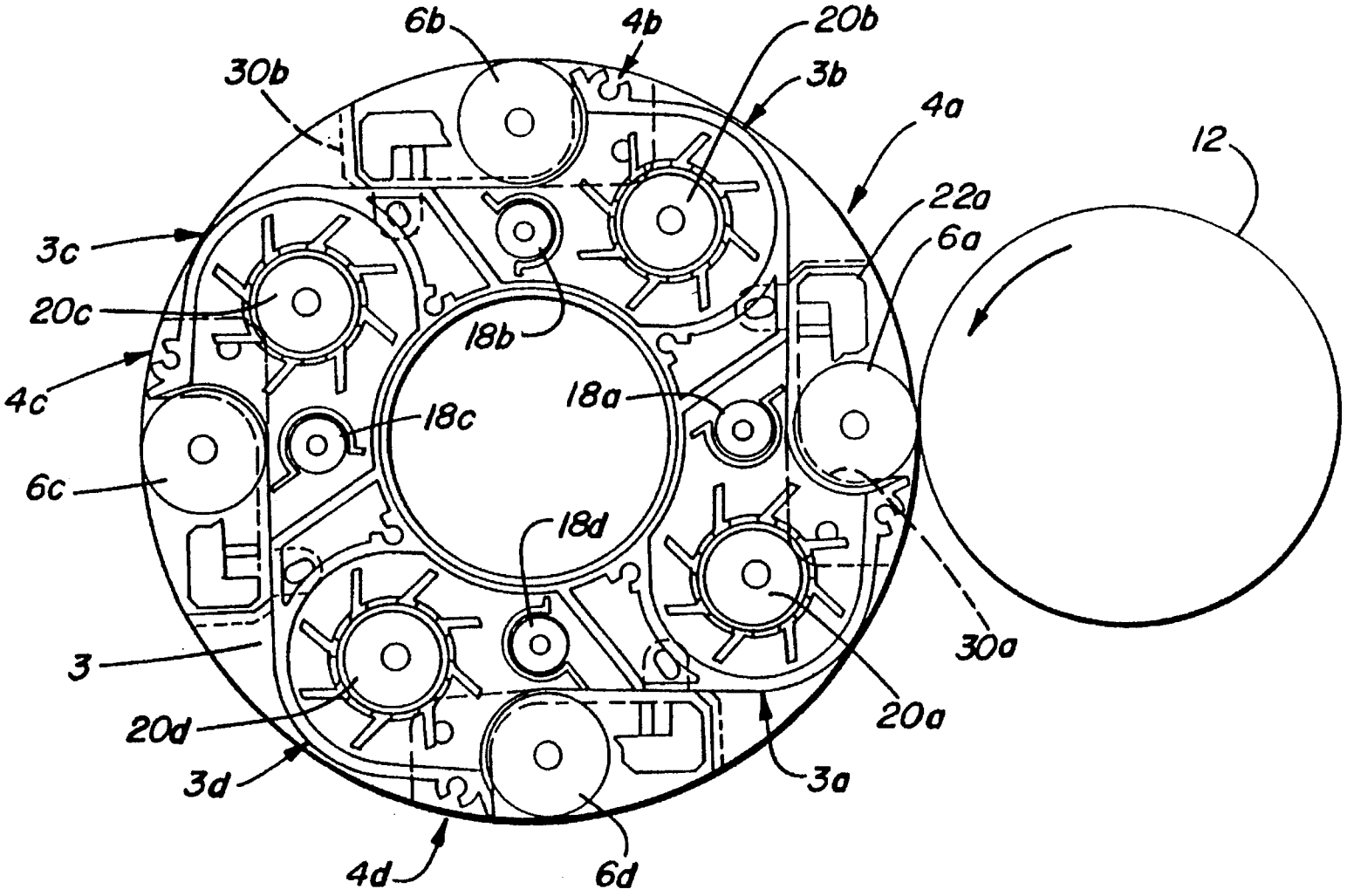
FIG. 3 shows a detailed side view of the rotary developing apparatus as shown in FIG. 1.

FIG. 3 shows a more detailed side view of modular developing units 4*a*–4*d*. Each developing unit has at least a corresponding pair of transport screw shafts 18 and 20, corresponding doctor blade 22 and developing roller 6. A set of the above-described modular components is placed in each of four compartments 3*a*–3*d* defined by the structure of main modular unit frame 3 as shown in FIG. 2.

Still referring to FIG. 3, toner is loaded onto each developing roller 6*a*–6*d* by the corresponding transport screw shaft 18*a*–18*d*. In order to assure a predetermined amount of toner on developing rollers 6*a*–6*d*, doctor blades 22*a*–22*d* remove excess toner and evenly spread toner on the roller surface. Before loading toner onto each developing roller 6*a*–6*d*, the toner must first be transported from an external toner cartridge (not shown) to the vicinity of the developing roller by transport screw shafts 18*a*–18*d*, as will be described below.

Figure 4:
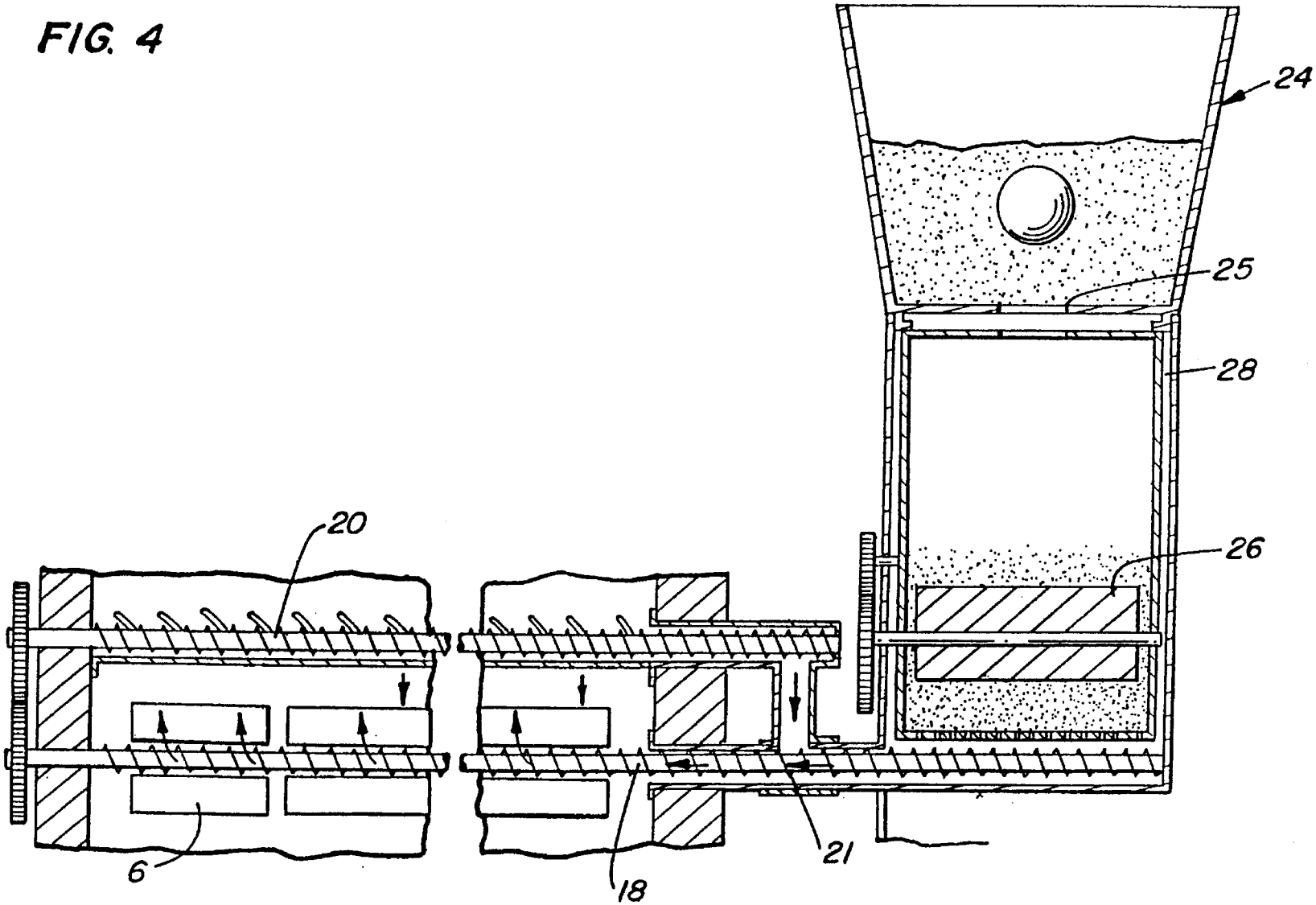
FIG. 4 shows a cross-sectional view of a toner transfer mechanism of the rotary developing apparatus.

Referring to FIG. 4, toner transport mechanism includes toner cartridge 24, toner supply unit 28, transport screw shafts 18 and 20, and toner transport duct 21. Toner stored in toner supply cartridge 24 is delivered to toner supply unit 28 through opening 25 mainly due to gravity. Toner passing into toner supply unit 28 is agitated and further transported to toner transport duct 21 by agitator/transport roller 26. Toner on rotating transport screw shaft 18 is pushed forward in transport conduit 21 towards a developing roller 6. Upon reaching developing unit 19, the toner is loaded onto the developing roller 6 as previously described. Excess toner is transported back towards toner cartridge 24 by second transport screw shaft 20.

Figure 5:
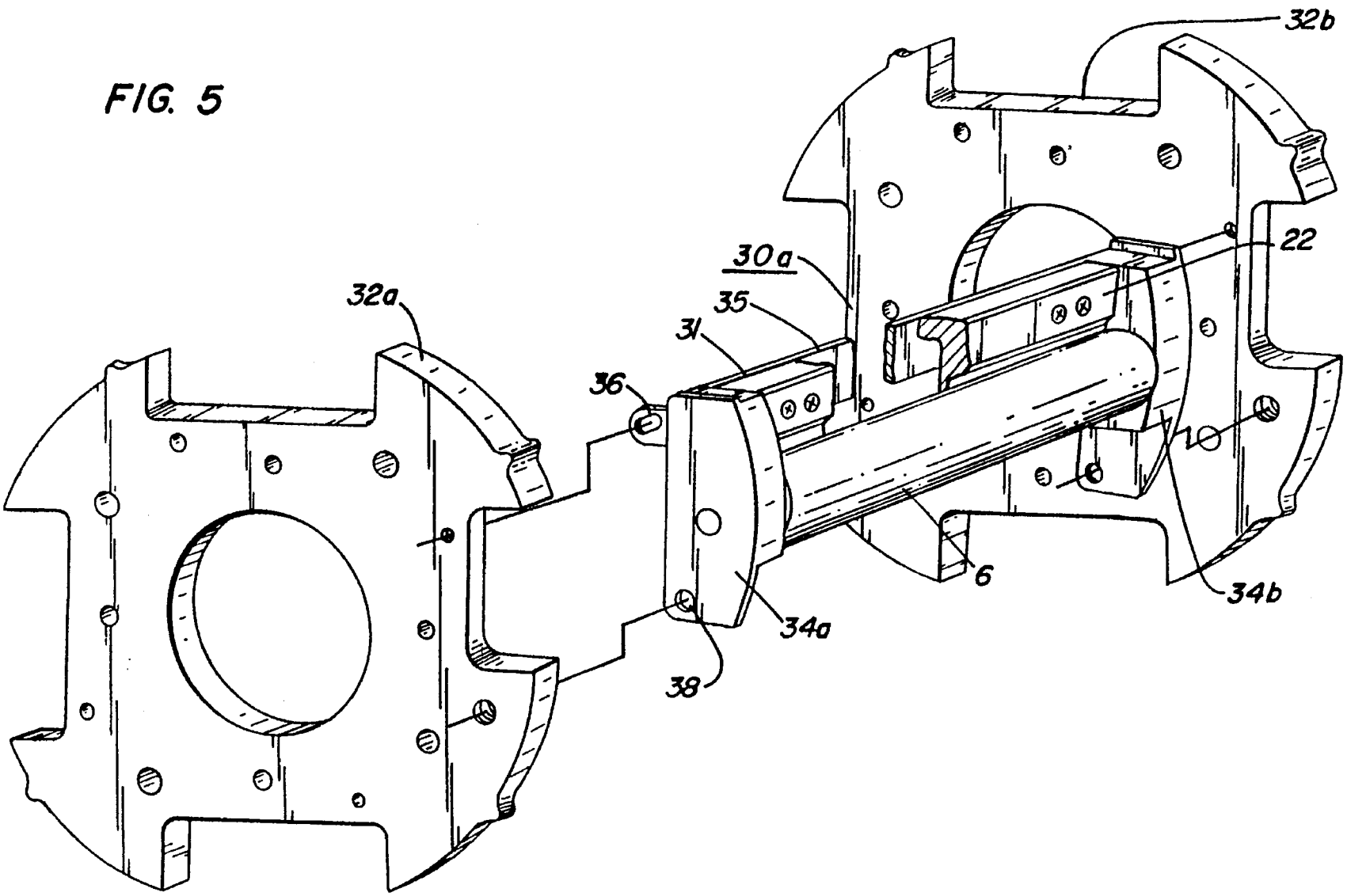
FIG. 5 shows a perspective view of one preferred embodiment of a submodular unit according to the current invention.

FIG. 5 shows an expanded perspective view of a submodular unit 30*a*. In general, a submodular unit frame 31 houses doctor blade 22 and a developing roller 6 and is adjustably mounted on side plates 32*a* and 32*b* by means of adjustable projection 36 and an anchoring bore 38. Although not shown in FIG. 5, according to one preferred embodiment of the current application, three other submodular units are mounted on side plates 32*a* and 32*b*. Each of submodular units 30*a*–30*d* is ultimately placed in the corresponding compartment of the main modular unit frame as shown in FIG. 3.

Still referring to FIG. 5, submodular unit frame 31 includes pair of side walls 34*a* and 34*b* and backplate 35 extending between side walls 34*a* and 34*b*. Developing roller 6 is rotatably held by side walls 34*a* and 34*b* while doctor blade 22 is mounted on backplate 35. Doctor blade 22 is preferably adjustably mounted to backplate 35 for providing an adjustable gap between the edge of the doctor blade and the developing roller surface. This vertical gap adjustment controls the amount of toner loaded on developing roller 6.

Figure 6:
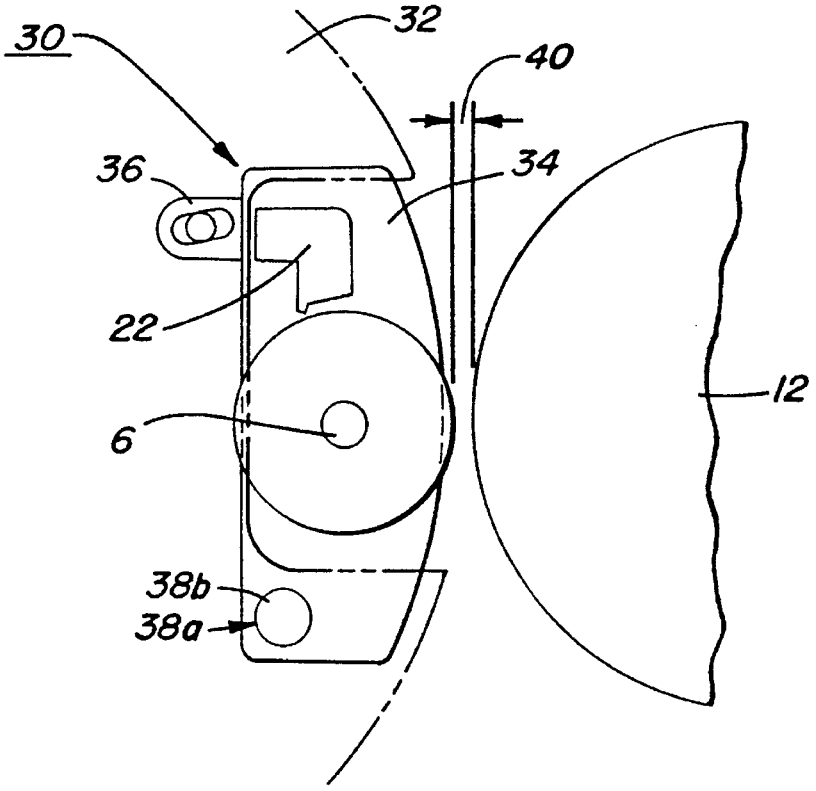
FIG. 6 illustrates an adjustable mechanism for adjusting a gap between a developing roller and a photoreceptor drum.

FIG. 6 shows that each side wall 34*a*, 34*b* of submodular unit frame 30 includes adjustable projection 36 and anchoring bore 38*a* which provide rotation adjustments around an anchoring axis. When submodular unit side walls 34*a* and 34*b* are mounted to main modular side walls 32*a* and 32*b* (indicated by the dotted line), one end of submodular unit side wall 34 is anchored to main modular side wall 32 by anchoring bore 38*a* and anchoring screw 38*b*. The other end of side wall 24 rotates around an axis of anchoring screw 38*b* in anchoring bore 38*b* for adjusting the spacial gap as indicated by a double headed arrow. This rotation is limited by an elongated slot in adjustable projection 36.

Referring to FIG. 6, as submodular unit frame 34 is rotated within a compartment of unit frame 3 to adjust gap 40 between developing roller 6 and the photoreceptor drum 12, the gap between toner blade 22 and developing roller 6 is kept constant. If doctor blade 22 is not mounted on submodular unit frame 30, the gap between blade 22 and developing roller 6 will change, and consequently the amount of toner loaded on developing roller 6 will be varied.

Still referring to FIG. 6, the rotation of submodular unit frame 30 adjusts the distance of gap 40 between developing roller 6 at the developing position and photoreceptor drum 12. In one preferred embodiment according to the current invention, gap distance 40 is specified at 0.57+/–0.1 mm for an optimal toner transfer from developing roller 6 to photoreceptor drum 12. While too much gap leads to dropping of toner before reaching photoreceptor drum 12, too little gap also leads to too much toner on photoreceptor drum 12. The adjustable range is determined by the slot length in adjustable projection 36 which approximately measures 10 mm. As the submodular unit frame rotates around anchoring screw 38*b*, the center of developing roller 6 vertically moves approximately +/–0.2 mm. This specification for the gap distance is also suitable for the Ricoh AZALEA copier product line which includes models A166-60, A166-01, A166-02, and A166-03.

According to another preferred embodiment of the current invention, developing roller 6 and photoreceptor drum 12 are rotated in opposite directions. This rotational arrangement also improves the toner transfer between the gap by reducing the amount of dropping of the toner across the gap.

Figure 7:
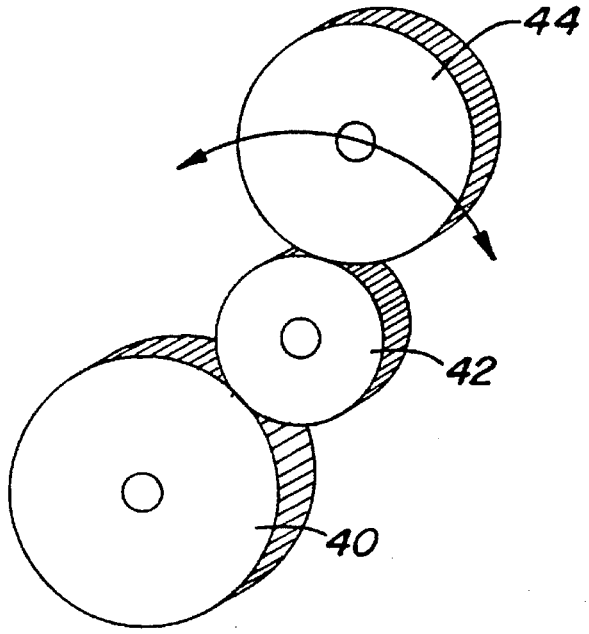
FIG. 7 shows a schematic diagram of gears for activating the developing rollers.

Referring to FIG. 7, set of gears 40–44 for activating developing roller 6 is schematically shown. Driving gear 40 is ultimately connected to a motor and drives a planetary gear 44 which activates developing roller 6 via intermediate gear 42. Planetary gear 44 and developing roller 6 share a common rotational axis, and the radius of these gears is predetermined in such way to accommodate the rotation of the submodular unit for the gap adjustment as described above with respect to FIG. 6. Planetary gear 44 moves around a rotational axis of intermediate gear 42 when the submodular unit is adjustably rotated. Thus, during the gap adjustment, planetary gear 44 rotates around the circumference of intermediate gear 42 without affecting the activation of developing roller 10.

Figure 8:
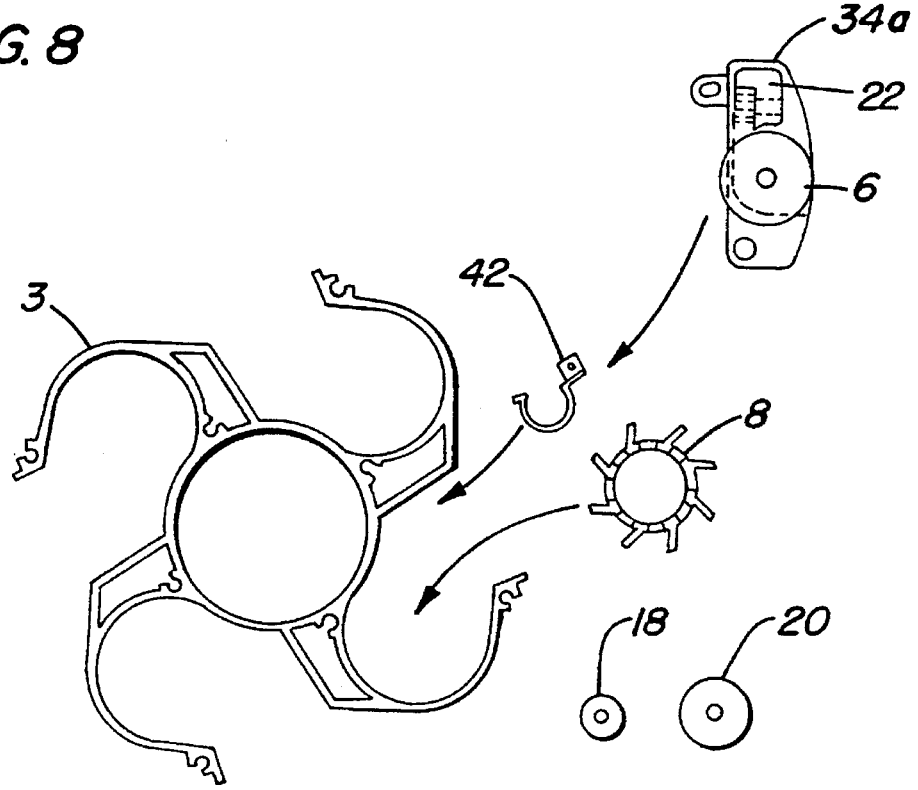
FIG. 8 shows an expanded side view of a modular unit frame, a submodular unit and toner transferring mechanisms.

FIG. 8 schematically shows a sequence of assembling the components of the rotary developing apparatus. For each developing unit, after placing a screw guide 42, toner transport screw shafts 18 and 20 along with paddles 8 are assembled into the developing unit. At this stage, preassembled submodular unit 30 is assembled into a main modular unit frame 3. As described above, pre-assembled submodular unit 30 includes doctor blade 22 and developing roller 6, and a distance of the gap between developing roller 6 and photoreceptor drum 12 is adjusted as submodular unit 30 is mounted. Because of this submodular design, the assembly process as well as the initial gap adjustment is simplified.

Maintenance of the rotary developing apparatus is also facilitated by the above-described submodular unit 30. For example, the subsequent gap adjustment after extended use is individually made for each developing unit. Since submodular unit 30 also accommodates a doctor blade, a constant space between the doctor blade and the developing roller is maintained after the gap adjustment. Additionally, as described above in relation to FIG. 7, the gap adjustment does not affect the activating gears. Another example of an advantage is that the replacement of the developing roller or a doctor blade is accomplished by swapping the submodular units.

The above-described submodular concept may be applicable to other components of the modular rotary developing apparatus. In other words, certain components may be combined into an additional submodular unit in the rotary developing apparatus for the purposes of gaining the above described and other advantages.

It is to be understood, however, that even though numerous characteristics and advantages of the present invention have been set forth in the foregoing description, together with details of the structure and function of the invention, particularly with respect to Ricoh copier product line AZALEA, models A166-60, A166-01, A166-02, and A166-03, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A modular rotary developing device, comprising a photoreceptor drum for developing an image on an image-carrying medium utilizing toner selectively applied to the photoreceptor drum, said device including a main modular unit frame having sub-dividing walls juxtaposed to the photoreceptor drum and a plurality of developing units housed in said main modular unit frame, each of said developing units comprising:

a developer container defined by said sub-dividing walls of said main modular unit frame for containing the toner;

a submodular unit frame mounted to said main modular unit frame for providing an independent detachable frame; and a developing roller mounted on said submodular unit frame for applying the toner onto the photoreceptor drum, said submodular unit frame along with said developing roller being detachable as a sub-unit from the main modular unit frame.

2. The device according to claim 1, further comprising:

a doctor blade adjustably mounted on said submodular unit frame and juxtaposing said developing roller for controlling an amount of the toner to be applied onto the photoreceptor drum.

3. The device according to claim 2, wherein said submodular unit frame further comprises:

a pair of side walls for supporting said developing roller;

a backplate connected to said side walls for supporting said doctor blade;

an anchoring device located on said side walls for rotatably mounting one end of said side wall to the main modular unit frame, defining a rotating axis; and an adjustable device located on said side walls for adjustably mounting the other end of said side walls to the main modular unit frame, said adjustable device limiting a range of rotation around said rotating axis and latching said side walls at a selected angle.

4. The device according to claim 3, wherein said anchoring device includes a first threaded hole on the main modular unit frame and a second threaded hole on said side wall and a screw secured to said first threaded hole and said second threaded hole.

5. The device according to claim 4, wherein said adjustable device includes a third threaded hole on the main modular unit frame and an elongated hole on said side wall and a screw secured to said second threaded hole but adjustably moving within said elongated hole.

6. The device according to claim 5, wherein a long axis of said elongated hole is angled with respect to a line connecting a center of said developing roller and another center of said photoreceptor drum.

7. The device according to claim 1 further comprising a plurality of said submodular unit frames each having a corresponding developing roller, said submodular units being each adjustably mounted on the main modular unit frame, the main modular unit frame rotating around a predetermined axis, one of said submodular units being juxtaposed to the photoreceptor drum defining a developing position, said submodular unit at said developing position being independently moveable for an adjustment of a gap between said developing roller at said developing position and the photoreceptor drum.

8. The device according to claim 7, wherein said submodular unit at said developing position is adjustably rotated around another predetermined axis for said adjustment of said gap.

9. The device according to claim 8, further comprising a set of gears for activating said developing roller, said developing roller being independently moved around an axis of rotation of one of said gears, said gears thus accommodating said adjustment of said gap by maintaining the same distance between any two of said gears.

10. The device according to claim 7, where said gap is adjusted so as to substantially eliminate dropping of the toner though said gap.

11. The device according to claim 10, wherein said developing roller and the photoreceptor drum rotate in opposite directions for further eliminating the dropping of the toner.

12. A rotary modular developing apparatus for reproducing an image, said image being visualized by toner selectively applied to a photoreceptor, comprising:

a rotary developing device having a main modular frame which provides a plurality of independent compartments, each of said compartments containing a different color of the toner, said rotary developing device juxtaposing one of said compartments to the photoreceptor drum for selectively applying the toner onto the photoreceptor drum, said juxtaposed compartment defining a developing positioned unit; and a plurality of submodular unit frames each adjustably mounted on said main modular frame, each of said submodular unit frames housing a developing roller for temporarily holding toner and a doctor blade for regulating the amount of toner on said developing roller, each of said submodular unit frames being independently moved with respect to the photoreceptor so as to adjust a gap between said developing roller of said developing positioned unit and the photoreceptor.

* * * * *